US006672394B2

(12) United States Patent
Neal

(10) Patent No.: US 6,672,394 B2
(45) Date of Patent: Jan. 6, 2004

(54) INTERCHANGEABLE COILED TUBING SUPPORT BLOCK AND METHOD OF USE

(75) Inventor: Mike Neal, Eastland, TX (US)

(73) Assignee: Heartland Rigs International, LLC, Dallas, TX (US)

( * ) Notice: Subject to any disclaimer, the term of this patent is extended or adjusted under 35 U.S.C. 154(b) by 38 days.

(21) Appl. No.: 10/166,206

(22) Filed: Jun. 10, 2002

(65) Prior Publication Data

US 2002/0189819 A1 Dec. 19, 2002

Related U.S. Application Data

(60) Provisional application No. 60/299,396, filed on Jun. 19, 2001.

(51) Int. Cl.[7] ..... E21B 19/00; E21B 19/22

(52) U.S. Cl. ..... 166/379; 166/77.2; 166/384; 226/173; 226/190

(58) Field of Search ..... 166/77.2, 77.3, 166/379, 384, 385; 226/173, 172, 190, 191, 193; 242/615.2, 615.4; 254/416

(56) References Cited

U.S. PATENT DOCUMENTS

| | | | | |
|---|---|---|---|---|
| 3,258,110 A | | 6/1966 | Pilcher | |
| 3,754,474 A | | 8/1973 | Palynchuk | |
| 5,094,340 A | | 3/1992 | Avakov | |
| 5,765,643 A | | 6/1998 | Shaaban et al. | |
| 5,853,118 A | | 12/1998 | Avakov | |
| 4,673,035 A | | 8/1999 | Gipson | |
| 5,971,666 A | | 10/1999 | Martin et al. | |
| 5,975,203 A | | 11/1999 | Payne et al. | |
| 6,189,609 B1 | | 2/2001 | Shaaban et al. | |
| 6,408,955 B2 | * | 6/2002 | Gipson | 166/384 |
| 6,425,441 B2 | * | 7/2002 | Shaaban et al. | 166/384 |
| 6,491,107 B2 | * | 12/2002 | Dearing et al. | 166/77.2 |

OTHER PUBLICATIONS

Amacoil, Inc., Amacoil/Uhing Linear Actuators, 2000.

Flennor,Division of Norco, Inc., Ball Reverser, 1997.

* cited by examiner

*Primary Examiner*—David Bagnell
*Assistant Examiner*—Brian Halford
(74) *Attorney, Agent, or Firm*—Elizabeth R. Hall

(57) ABSTRACT

The present invention includes an interchangeable coil tubing support block that provides a means for quickly adapting a wheel system for wheel-type coiled tubing injectors for a wide variety of tubing sizes. In addition, the present invention provides a light weight, robust, and wear resistant means of contacting and fully supporting the tubing while it is being injected into and withdrawn from a well.

21 Claims, 5 Drawing Sheets

INTERCHANGEABLE COILED TUBING SUPPORT BLOCK AND METHOD OF USE

CROSS-REFERENCE TO RELATED APPLICATION

The present application, pursuant to 35 U.S.C. 111(b), claims the benefit of the earlier filing date of provisional application Ser. No. 60/299,396 filed Jun. 19, 2001, and entitled "Interchangeable Coiled Tubing Support Block."

FIELD OF THE INVENTION

The present invention relates to coiled tubing handling equipment for use in drilling, production, and servicing of wells used for production of petroleum products. The invention is used on wheel type coiled tubing injectors that are used to insert and withdraw coiled tubing from wells.

BACKGROUND OF THE INVENTION

When continuous coiled tubing is to be used in a well as a service tubing string, a production string, or a drill string, it must be taken from a reel, forced into the well, manipulated, withdrawn from the well, and stored back on its reel. Generally the well is either under or potentially under some pressure, so that the friction of a sealing gland or blowout preventer at the top of the wellhead must be overcome. Further, well pressure may strongly resist insertion of the tubing into the well. While the tubing is being recovered from the well, the weight of the tubing must be lifted from the well. Additionally, there may be substantial friction between the coiled tubing and the well tubing or casing to be overcome while the coiled tubing is in the well, particularly if the well is deviated from vertical. For these reasons, means have been developed to apply axial thrusts to the string of coiled tubing at the wellhead. These means are commonly termed coiled tubing injectors in the oilfield industry.

Two basic types of coiled tubing injector are used. The first and most common type consists of opposed tracks analogous to the tracks on a crawler tractor, which clamp and thereby grip the tubing between the tracks so that the tracks can transmit axial loadings into the tubing by friction. This track-type type of injector is manufactured and sold by Hydra-Rig, Inc. and others. U.S. Pat. Nos. 3,258,110, 5,188,174, 5,309,990, and 5,975,203 show track-type injectors.

The second type of tubing injector uses a wheel with opposed pinch rollers, which force the tubing against the rim of the wheel. When torque is applied to the wheel, frictional shear forces cause axial loads to be transmitted to the tubing. This wheel-type of injector is manufactured and sold by Coiled Tubing Systems and Vita International, Inc. U.S. Pat. Nos. 4,673,035 and 5,765,643 show examples of this type of injector system.

A serious problem, which arises with the use of coiled tubing for both types of tubing injectors is related to progressive cross-sectional ovaling as a consequence of repeated bending beyond the yield point of the tubing material. This undesirable effect may be minimized, given that other design factors are constant, by providing grooved contact surfaces, which closely conform to the tubing diameter.

U.S. Pat. Nos. 3,754,474, 5,094,340, 5,853,118, and 6,189,609 show means for supporting the tubing for track-type injectors. Initially, some designers used separate sets of drive chain-mounted blocks for each tubing size, each set being grooved specifically to fit a given tubing size. U.S. Pat. No. 3,754,373 relies upon an elastomeric pad with embedded gripper studs on the face of the individual drive chain-mounted blocks. For this configuration, the elastomer deforms to accommodate the particular tubing which it contacts. U.S. Pat. Nos. 5,094,340 and 5,853,118 use a Vee groove block which reduces the cross-sectional bending stresses relative to those of a single contact line block by providing two lines of contact approximately 90° apart. The advantage of a Vee groove block is that the block can be used with a wide range of tubing sizes. However, if high transverse squeeze is used to enhance the frictional transfer of drive force from the drive chain-mounted blocks to the tubing, excessive ovaling may occur with Vee grooves. Shaaban et al. in U.S. Pat. No. 6,189,609 B1 shows an insertable gripper block made of resilient material for use with composite coiled tubing fabricated from plastics and reinforcing fibers. This particular arrangement has the gripper block material selected for its high friction against the tubing and its relatively less aggressive wear tendencies when contacting the soft tubing.

Gipson in U.S. Pat. No. 4,673,035 discloses a wheel-type injector, which uses a permanent rubber insert on the wheel perimeter to support the tubing. As configured, the system would possibly require a different wheel for at least some of the currently available coiled tubing sizes and the rubber insert on the wheel perimeter is subject to wear.

For track-type coiled tubing injectors, the changing of the blocks that will contact the tubing is expensive due to the amount of equipment down time required. For wheel-type injectors, the interchange of drive wheels to accommodate different tubing sizes is also very time consuming and additionally requires lifting equipment. However, larger coiled tubing with its more severe bending cycles and higher squeeze loads coupled with higher radial loads from increased tension for wheel-type injectors in the injector necessitate better cross-sectional support for the tubing.

While operational time savings are important for operators of wheel-type injectors, weight reduction for the overall system is also important for reducing operating costs and permitting larger tubing loads with the rig. Coiled tubing rig weights are limited by regulations on vehicle weight and bridge load capacities. The use of light weight alloys, such as aluminum, for the relatively large rim portion of a wheel-type injector would appear advantageous, but the very poor wear properties of aluminum and other light metals preclude their use for pipe contact. The portion of the wheel system which contacts the tubing must be able to resist wear while offering good frictional properties even when the tubing has residual water, drilling mud, or petroleum products on its surface.

Thus, a need exists for a wheel system for wheel-type coiled tubing injectors that have a light weight, robust, and wear resistant means of contacting and fully supporting the tubing while, at the same time, offering the advantages of quick adaptation for other sizes of tubing.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

SUMMARY OF THE INVENTION

The invention contemplates a simple, inexpensive device for solving the problems and disadvantages of the prior approaches discussed above. The present invention includes an interchangeable coil tubing support block that provides a means for quickly adapting a wheel system for wheel-type coiled tubing injectors for a wide variety of tubing sizes.

In accordance with one aspect of the invention is a drive wheel assembly for use in a wheel-type coiled tubing injector comprising: a drive wheel with a concentric axis of rotation and a rim having an annular groove; a number of carrier blocks having an upper side and a lower side, where the lower side is attached to the annular groove of the rim of the drive wheel; and a number of insert blocks, where each insert block has a first side selectably securable to the upper side of a corresponding carrier block and an opposed side having an arcuate surface for supporting a portion of coiled tubing in contact with the arcuate surface.

In accordance with another aspect of the invention is a drive wheel assembly for use in a wheel-type coiled tubing injector comprising: a drive wheel having a concentric axis of rotation and a rim having an annular groove; a carrier block having a stepped flat on a lower side, the stepped flat mates with the groove of the rim of the drive wheel, and an upper side comprising a semicylindrical groove along a length of the upper side, said semicylindrical groove has a transverse shouldering groove approximately midway along the length of the upper side of the carrier block, wherein multiple carrier blocks form a continuous array around the circumference of the rim; an insert block having a semicylindrical exterior that mates with the semicylindrical groove of the carrier block, said semicylindrical exterior having a central upset portion that fits into the shouldering groove of the carrier block, and an arcuate interior for supporting a portion of a coiled tubing, wherein the radius of the arcuate interior is selected to correspond to the radius of the coiled tubing to be supported by the arcuate interior; and an attachment element for reversibly attaching the insert block to the carrier block.

BRIEF DESCRIPTION OF THE DRAWINGS

The novel features which are believed to be characteristic of the invention, both as to its organization and methods of operation, together with the objects and advantages thereof, will be better understood from the following description taken in conjunction with the accompanying drawings, wherein:

FIG. 6 shows an oblique exploded view of the carrier block and insert block of FIG. 5 where the internal arcuate surface has a plurality of holes.

DETAILED DESCRIPTION OF THE INVENTION

The present invention provides a simple, inexpensive interchangeable coiled tubing support block that provides a means for quickly adapting wheel-type coiled tubing injectors wheel systems to handle a wide variety of tubing sizes.

Figure 1:
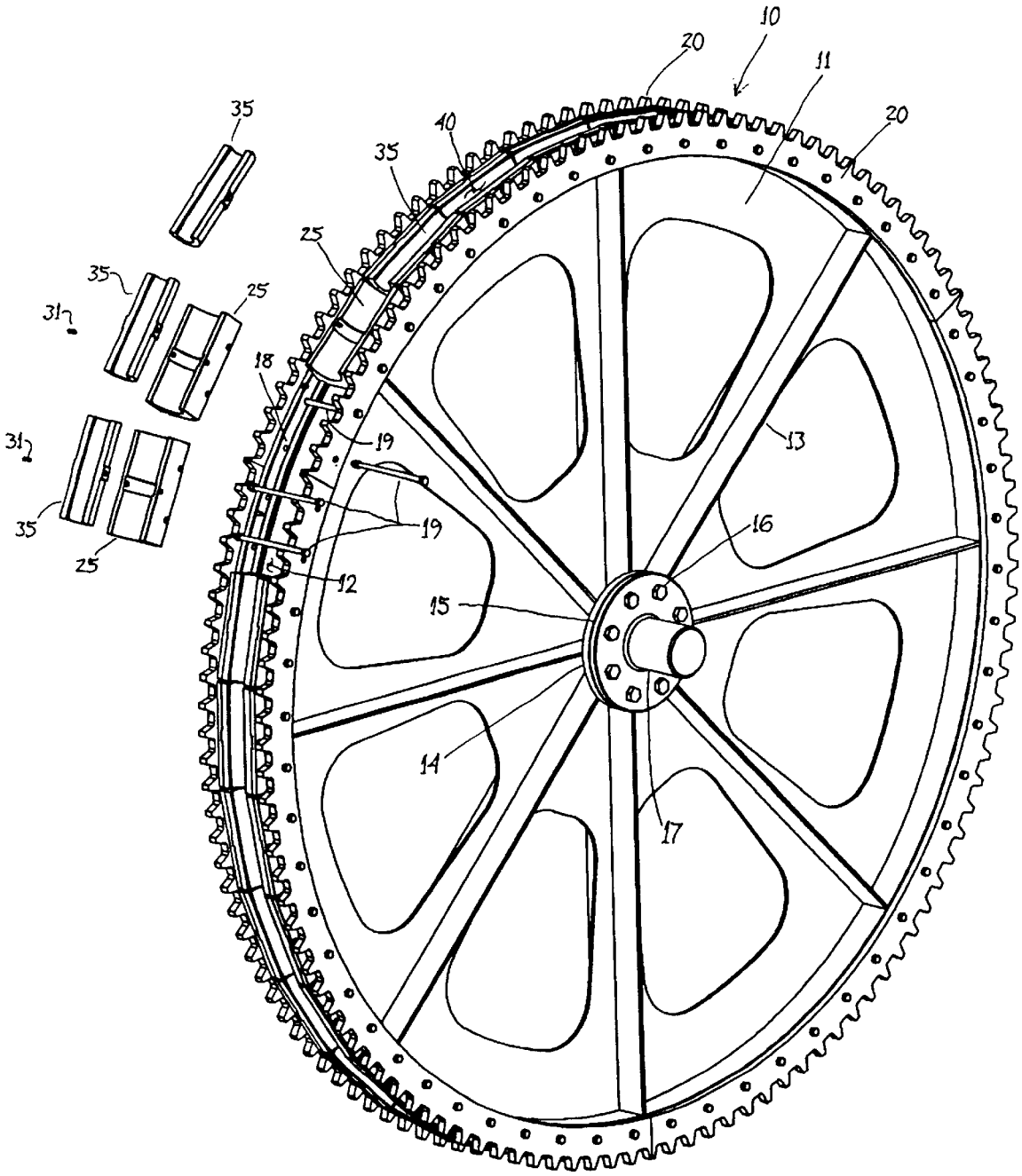
FIG. 1 is an oblique view of a wheel from a wheel-type coiled tubing injector showing the mounting of the carrier blocks and the insert blocks.
Figure 4:
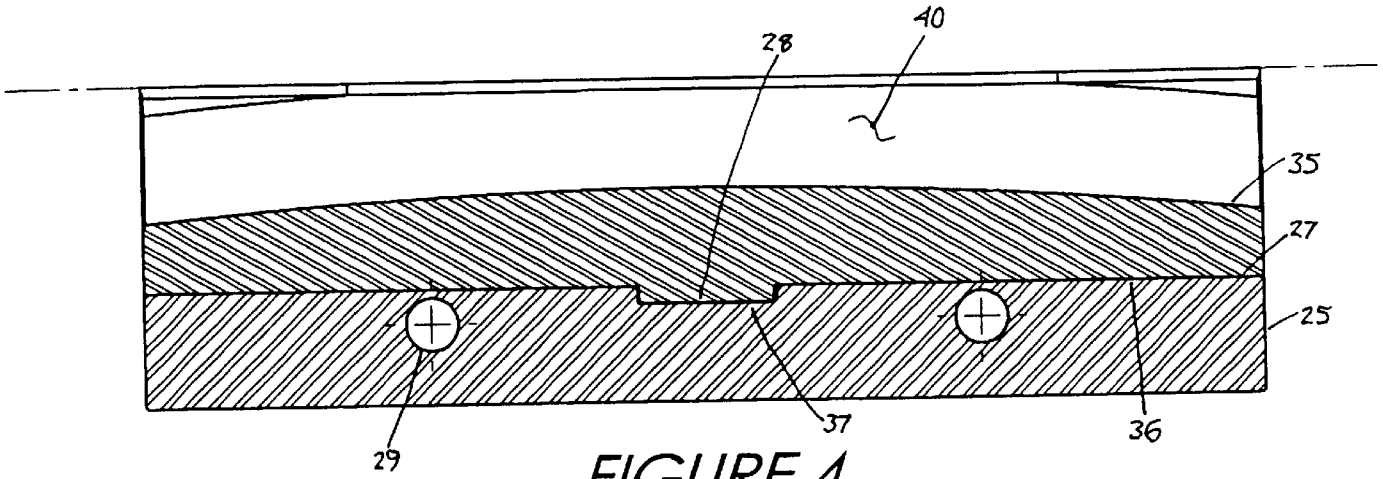
FIG. 4 illustrates a longitudinal cross-section of the carrier block with installed insert block of FIG. 2.
Figure 3:
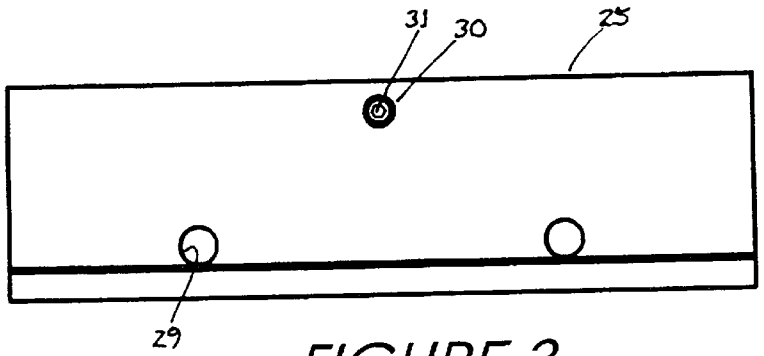
FIG. 3 illustrates a side view of the carrier block with installed insert block of FIG. 2.
Figure 2:
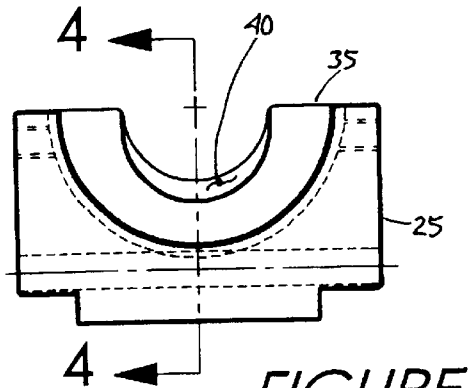
FIG. 2 shows the end view of a carrier block with an insert block installed.

Referring now to the drawings, and initially to FIG. 1, it is pointed out that like reference characters designate like or similar parts throughout the drawings. The Figures, or drawings, are not intended to be to scale. For example, purely for the sake of greater clarity in the drawings, wall thickness and spacing are not dimensioned as they actually exist in the assembled embodiment.

A typical drive wheel assembly 10 for a wheel-type coiled tubing injector is shown in FIG. 1. The assembly consists of a basic drive wheel 11 having an annularly grooved rim 12, multiple radial spokes 13, and mirror-image hub sections 14. Each hub section 14 has an outward facing mounting flange 15 transverse to the axis of wheel 11 and having a bolt circle. Comating stub shafts 17 are each provided with a concentric transverse flange having a bolt circle corresponding to that of the hub sections 14. Multiple bolts with nuts 16 are used in the bolt holes of the stub shafts 17 and hub sections 14 to connect the pieces. In operation, the stub shafts 17 are supported by bearings and other structure s approximating those shown in Gipson U.S. Pat. No. 4,673,035. Such support structure is not shown or discussed here, as it is not part of this patent. Multiple bolt holes 18 parallel to the axis of wheel 11 and penetrating both transverse sides of rim 12 are arranged in pairs around the rim of the wheel. Each pair of bolt holes is used to support a carrier block.

Annular sprockets 20 are attached, using through bolts 19 with nuts, on each of the outer sides of the rim 12 of wheel 11. Sprockets 20 are provided with through bolt holes for mounting to wheel 11 and are separated into arcuate segments for ease of handling. The through bolts 19 pass through the bolt holes of the sprocket 20 on a first transverse side of rim 12, through the coaxial corresponding bolt holes 18 of wheel 11 parallel to the wheel axis on both transverse faces of the rim, and then through the bolt holes of the other sprocket on the second transverse side of the rim.

Figure 5:
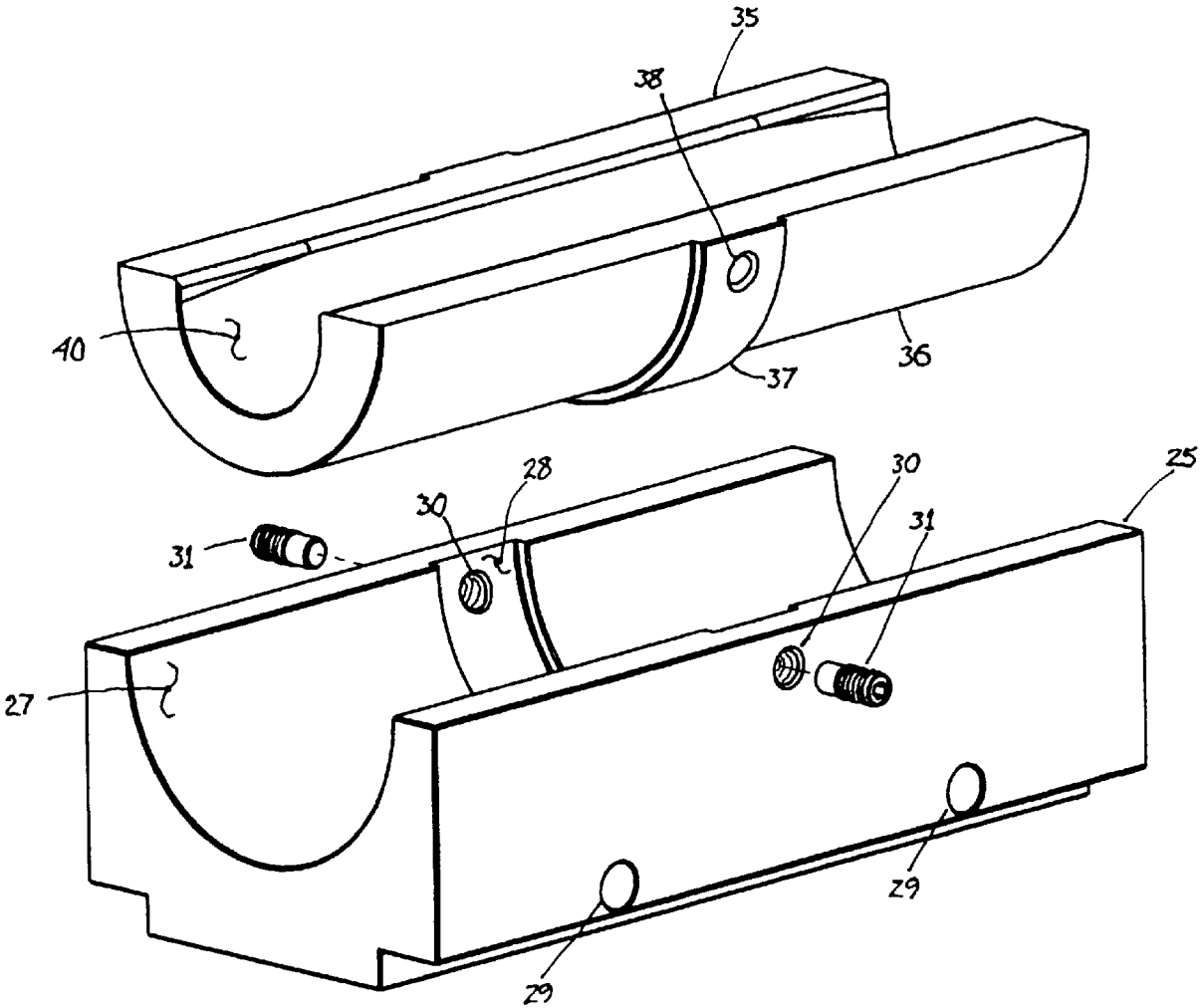
FIG. 5 shows an oblique exploded view of a carrier block and insert block with the retention screws used to hold the insert block in place.
Figure 4:
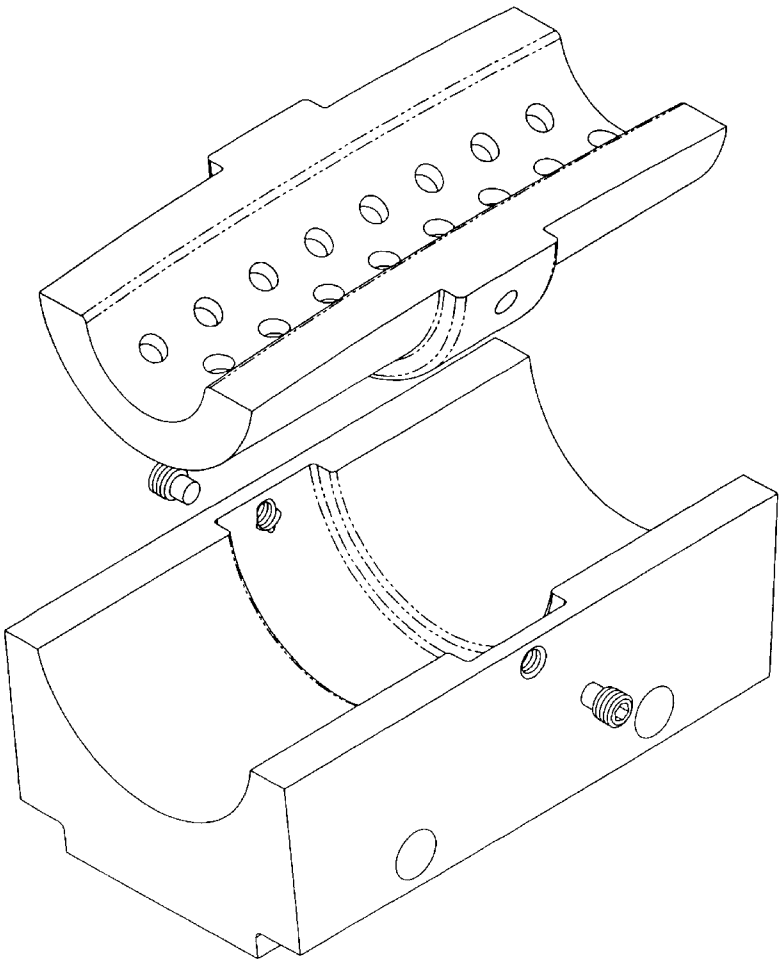

Referring to FIG. 1, multiple carrier blocks 25, shown in detail in FIGS. 2–5, are mounted in the annular groove of rim 12 of wheel 11. For clarity in FIG. 1, two of the carrier blocks have been removed from the rim 12 of wheel 11, along with three of the four bolts with nuts 19, and one of the insert blocks is removed from an in-place carrier block. The carrier blocks 25 have double symmetry about two of their median planes. The sides of carrier blocks 25 are flat and parallel, while the bottom surfaces are normal to the sides and consist of stepped flats. The central flats have a width and depth so that they serve to centralize the carrier blocks in the annular groove of rim 12 of wheel 11. The upper surfaces of the carrier blocks are flat and transverse to the sides and with central semicylindrical grooves 27 running the length of the carrier blocks. In the middle of the groove 27 of the carrier blocks 25 is a transverse coaxial semicylindrical shouldering groove 28. Transverse to the sides of each carrier block are two through holes 29 symmetrical about the center of the block and close to the bottom of the block. These holes 29 can be aligned with the pairs of bolt holes 18 of the rim 12 of wheel 11 and the corresponding bolt holes of sprockets 20 so that bolts with nuts 19 can be used both to retain the sprockets and to also structurally mount the carrier blocks 25. In the middle of each of the sides of the carrier blocks near the upper edge is a transverse drilled and tapped through hole 30, as can be seen in FIG. 5. These holes 30 are coaxial and intersect with the groove 28. A dog point or half dog point set screw 31 is screwed into each hole 30. The material used for carrier blocks 25 preferably will be aluminum in order to minimize overall structure weight.

Multiple, interchangeable insert blocks 35 have a semicylindrical exterior 36 with a central upset portion 37, which has, transverse shoulders on both sides. As shown in FIG. 5, the length of an insert block 35 is the same as that of a carrier block 25, and the length of the central upset 37 is selected to be a close fit to the shouldering groove 28. In the middle of the central upset and offset from the diametral 25 plane which defines the flats for the semicylinder of insert block 35 are external coaxial retainer holes 38. One retainer hole 38 is located on each side of the insert block. The retainer holes 38 are coaxial with the transverse drilled and tapped holes 30 of the carrier block 25 when the insert block 35 is nested into the carrier block 25. The interior tubing support surface 40 of insert block 35 is a U-shaped arcuate surface having a radius in the bottom of the U corresponding to a preselected size of coiled tubing plus a small clearance to allow for tubing size variations, ovaling, and pressure expansion. The radius of the arc of the U-shaped arcuate surface 40 corresponds to the radial distance from the axis of wheel 11 which it would have when the insert block 35 is mounted in a carrier block 25 which is in turn mounted on rim 12 of wheel 11. The material used for the insert blocks is selected for wear resistance and strength and, additionally, for having a relatively high friction coefficient with the tubing material. Typically, the insert block material would be a high strength low alloy steel or ductile iron or austempered ductile iron. For cases where very high axial loads are required in the coiled tubing, tungsten carbide grit or similar friction enhancing materials may be emplaced on the arcuate surface 40 of insert blocks 35 by means of flame spraying or other suitable means. Alternatively, the arcuate surface 40 may have a plurality of holes to assist in gripping the tubing.

OPERATION OF THE INVENTION

The wheel assembly 10 has the wheel 11 with the stub shafts attached by means of bolts and nuts 16 permanently mounted in the set of support bearings of a wheel-type coiled tubing injector assembly, such as that shown in Gipson U.S. Pat. No. 4,673,035. Both the carrier blocks 25 and sprockets 20 are structurally attached to the rim 12 of wheel 11 by means of bolts with nuts 19 mounted through bolt holes 18. Each of the insert blocks 35 for a given size of coiled tubing is positioned and structurally supported in a carrier block 25 and retained therein by means of screws 30 engaging retainer holes 38. For a mated carrier block 25 and insert block 35, the shoulders of the central coaxial semicylindrical groove 28 of carrier block 25 serve to transfer tangential forces to the insert block 35 through the comating shoulders of central semicylindrical upset 37 on the exterior of the insert block. The insert blocks 35 thus present a nearly continuous grooved surface of constant groove radius to the tubing which engages the wheel 11. The size of the gaps between the individual insert blocks is selected to be insufficient to distress the tubing by causing local intensifications of bending at the gaps.

Figure 7:
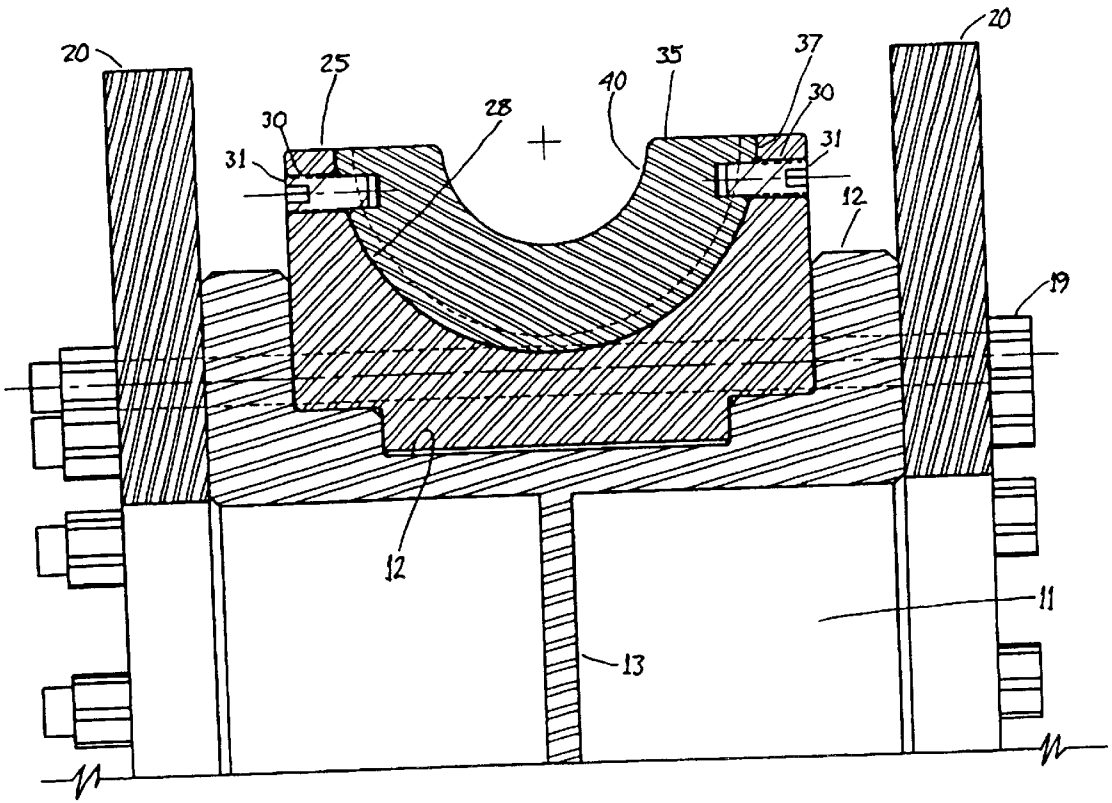
FIG. 7 is a transverse section through the middle of a carrier block and insert block installed on a wheel-type coiled tubing injector.

When it is desired to change the insert blocks so that a different size of coiled tubing may be accommodated, the individual insert blocks 35 may be released by backing out the screws 30 which retain each insert in its respective carrier block 25, removing the insert block, replacing the insert block with the new size of insert block, reengaging the screws 30 into the retainer holes 38 of the insert block. As can be seen in FIG. 7, there is sufficient space to access the screws 30 between the sprockets 20 and the side of the carrier blocks 25.

Numerous advantages result from the construction of a wheel-type coiled tubing injector disclosed herein. Use of aluminum or other light weight material, rather than steel, for the carrier blocks permits a reduction in overall weight for the entire wheel assembly. The minimization of the size and attendant weight of the interchangeable portion of the wheel assembly when reconfiguring the wheel for a different tubing size greatly eases the operator effort and time needed for such an operation. The use of the insert blocks with the carrier blocks allows the minimization of the size and weight of the interchangeable elements. The use of aluminum for a unitized block is unsatisfactory because of the poor wear properties of the material. However, the configuration of this invention permits selecting optimal properties for the insert block so that wear and frictional properties can be much improved when compared to an unitized aluminum block. Flame sprayed or similarly applied friction enhancement material is readily applied to ferrous metals, but generally is unsuited for application to aluminum because of its surface chemistry and its high flexibility and attendant inability to provide good structural support for hardfacing relative to ferrous metals. As a consequence of the construction of this invention, operational economies are available as a result of reduced changeover time for different tubing sizes. The reduction in weight for the wheel system in turn permits more capacity on the storage reel for the coiled tubing rig.

As will be understood readily by those skilled in the art, various changes in the configuration of this invention can be made without departing from the spirit of the invention. For example, the wheel and carrier blocks could interface differently, and the insert blocks could be shaped differently on the exterior.

What is claimed is:

1. A drive wheel assembly for use in a wheel-type coiled tubing injector, said wheel assembly comprising:

(a) a drive wheel having a concentric axis of rotation and a rim having an annular groove;

(b) plurality of carrier blocks having an upper side and a lower side, the lower side attached to the annular groove of the rim of the drive wheel; and (c) plurality of insert blocks, wherein each insert block has a first side selectably securable to the upper side of a corresponding carrier block and an opposed side having an arcuate surface for supporting a portion of coiled tubing in contact therewith.

2. The drive wheel assembly of claim 1, wherein secured pairs of insert blocks and carrier blocks form a continuous array around the exterior circumference of the rim.

3. The drive wheel assembly of claim 1, wherein the carrier blocks are made of a first metallic material.

4. The drive wheel assembly of claim 3, wherein the insert blocks are made of a second metallic material, said second metallic material is more dense than the first metallic material.

5. The drive wheel assembly of claim 3, wherein the first metallic material is an aluminum alloy.

6. The drive wheel assembly of claim 1, wherein the arcuate surface of the insert blocks has a friction enhancing material deposited thereon.

7. The drive wheel assembly of claim 1, wherein the insert block has a length substantially equal to a length of the carrier block.

8. The drive wheel assembly of claim 1, wherein the arcuate surface has a radius substantially equal to the radius of a coiled tubing selected to be supported by the arcuate surface during the operation of the drive wheel assembly.

9. The drive wheel assembly of claim 1, wherein the arcuate surface is perforated.

10. A drive wheel assembly for use in a wheel-type coiled tubing injector, said wheel assembly comprising:

(a) a drive wheel having a rim, the rim having an annular groove;

(b) plurality of carrier blocks having a semicylindrical groove running along a length of an upper side of the carrier block and a stepped flat on an opposed lower side, wherein the stepped flat mates with the groove of the rim of the drive wheel;

(c) plurality of insert blocks, wherein each insert block has a first semicylindrical side nestable into the semicylindrical groove of a corresponding carrier block and an opposed side with an arcuate surface for supporting a portion of coiled tubing in contact therewith; and (d) selectably operable retention means for structurally securing the insert blocks nested into the corresponding carrier blocks.

11. The drive wheel assembly of claim 10, wherein the insert blocks are made of a metallic material.

12. The drive wheel assembly of claim 10, wherein the insert blocks are removable from the corresponding carrier blocks.

13. The drive wheel assembly of claim 10, wherein the retention means is a bolt.

14. The drive wheel assembly of claim 10, wherein the carrier blocks are lighter than the insert blocks.

15. A drive wheel assembly for use in a wheel-type coiled tubing injector comprising:

(a) a drive wheel having a concentric axis of rotation and a rim having an annular groove;

(b) a carrier block having a stepped flat on a lower side, the stepped flat mates with the groove of the rim of the drive wheel, and an upper side comprising a semicylindrical groove along a length of the upper side, said semicylindrical groove has a transverse shouldering groove approximately midway along the length of the upper side of the carrier block, wherein multiple carrier blocks form a continuous array around the circumference of the rim;

(c) an insert block having a semicylindrical exterior that mates with the semicylindrical groove of the carrier block, said semicylindrical exterior having a central upset portion that fits into the shouldering groove of the carrier block, and an arcuate interior for supporting a portion of a coiled tubing, wherein the radius of the arcuate interior is selected to correspond to the radius of the coiled tubing to be supported by the arcuate interior; and (d) an attachment element for reversibly attaching the insert block to the carrier block.

16. The drive wheel assembly of claim 15, wherein the attachment element has a threaded section.

17. The drive wheel assembly of claim 15, wherein the carrier block is made of an aluminum alloy.

18. The drive wheel assembly of claim 15, wherein the arcuate surface of the insert blocks has a friction enhancing material deposited thereon.

19. The drive wheel assembly of claim 15, wherein the insert block has a length substantially equal to a length of the carrier block.

20. The drive wheel assembly of claim 15, wherein the arcuate surface is perforated.

21. A method for replacing the coiled tubing contact surface of a drive wheel assembly for use in a wheel-type coiled tubing injector comprising the steps:

(a) determining the radius of a coiled tubing to be injected or withdrawn from a well by a coiled tubing injector having a drive wheel assembly comprising (i) a drive wheel having a rim, the rim having an annular groove, (ii) plurality of carrier blocks having a semicylindrical groove running along a length of an upper side of the carrier block and a stepped flat on an opposed lower side, wherein the stepped flat mates with the groove of the rim of the drive wheel, (iii) plurality of removable insert blocks, wherein each insert block has a first semicylindrical side nestable into the semicylindrical groove of a corresponding carrier block and an opposed side with an arcuate surface for supporting a portion of the coiled tubing in contact therewith, and (iv) a selectably operable attachment element for securing the insert block to the carrier block;

(b) releasing an original set of insert blocks from the carrier blocks, wherein the carrier blocks form a continuous array around the exterior circumference of the rim of the drive wheel;

(c) removing the original set of insert blocks from the array of carrier blocks;

(d) selecting a second set of insert blocks, wherein the arcuate surface of the second set of insert blocks has a radius substantially equal to the radius of the coiled tubing to be injected;

(e) inserting the second set of insert blocks into the array of carrier blocks; and (f) securing the second set of insert blocks to the carrier blocks with the attachment element.

* * * * *